US009764448B2

(12) United States Patent
Levashov et al.

(10) Patent No.: US 9,764,448 B2
(45) Date of Patent: Sep. 19, 2017

(54) BINDER FOR THE FABRICATION OF DIAMOND TOOLS

(75) Inventors: Evgeny Aleksandrovich Levashov, Moscow (RU); Vladimir Alekseevich Andreev, Moscow (RU); Viktoriya Vladimirovna Kurbatkina, Moscow (RU)

(73) Assignee: National University of Science and Technology "MISiS", Moscow (RU)

( * ) Notice: Subject to any disclaimer, the term of this patent is extended or adjusted under 35 U.S.C. 154(b) by 1871 days.

(21) Appl. No.: 12/084,923

(22) PCT Filed: Sep. 25, 2006

(86) PCT No.: PCT/RU2006/000491

§ 371 (c)(1),
(2), (4) Date: May 29, 2008

(87) PCT Pub. No.: WO2007/055616

PCT Pub. Date: May 18, 2007

(65) Prior Publication Data

US 2009/0107291 A1 Apr. 30, 2009

(30) Foreign Application Priority Data

Nov. 14, 2005 (RU) ..... 2005135024
Nov. 14, 2005 (RU) ..... 2005135025
Nov. 14, 2005 (RU) ..... 2005135026

(51) Int. Cl.

*B22F 1/00* (2006.01)
*B24D 3/06* (2006.01)
*C22C 33/02* (2006.01)
*C22C 32/00* (2006.01)

(52) U.S. Cl.

CPC ..... *B24D 3/06* (2013.01); *C22C 32/00* (2013.01); *C22C 33/0257* (2013.01); *B22F 2998/00* (2013.01)

(58) Field of Classification Search

None

See application file for complete search history.

(56) References Cited

U.S. PATENT DOCUMENTS

| | | | | |
|---|---|---|---|---|
| 5,482,530 | A | 1/1996 | Höhne | |
| 6,254,658 | B1 * | 7/2001 | Taniuchi et al. | 75/240 |
| 6,319,460 | B1 | 11/2001 | Fang | |
| 6,663,682 | B2 | 12/2003 | Baldoni et al. | |
| 2002/0055002 | A1 * | 5/2002 | Toshima | B22F 1/0096 428/469 |
| 2005/0180875 | A1 * | 8/2005 | Kang | 419/15 |
| 2006/0093859 | A1 * | 5/2006 | Konyashin et al. | 428/698 |

FOREIGN PATENT DOCUMENTS

| | | | | |
|---|---|---|---|---|
| DE | WO2004/007784 | * | 1/2004 | C22C 29/08 |
| JP | 7-207301 | | 8/1995 | |
| JP | 2-972623 | | 9/1998 | |
| RU | 2167262 | | 5/2001 | |
| RU | 2172238 | | 5/2001 | |
| RU | 23815 | | 7/2002 | |
| RU | 2207320 | | 6/2003 | |
| RU | 2247794 | | 3/2005 | |
| SU | 1021586 | | 6/1983 | |
| SU | 1057263 | | 11/1983 | |
| SU | 1703427 | | 1/1992 | |
| SU | 1167840 | | 10/1999 | |

OTHER PUBLICATIONS

International Search Report.

English translation of the International Preliminary Report on Patentability.

Kimberly Hawthorne, "The Recommended Speeds & Feeds for Cermet Machining Tool Steel", Date Unknown, downloaded May 19, 2012, http://www.ehow.com/info_7997780_recommended-cermet-machining-tool-steel.html.

Ronald Biagiotto, Robert Macek, "The Time is Right for Cermets", Cutting Tool Engineering, Mar. 1996 / vol. 48 / No. 2, downloaded May 19, 2012, http://www.ctemag.com/dynamic.articles.php?id=173.

George F. Vander Voort, "Preparation of Ceramics, Cermets, Nitrides, Borides and Sintered Carbides", Date Unknown, downloaded May 19, 2012, http://www.georgevandervoort.com/mic_met_pdf/Preparation_of_Ceramics.pdf.

* cited by examiner

*Primary Examiner* — Yoshitoshi Takeuchi

(74) *Attorney, Agent, or Firm* — Lambert & Associates; Gary E. Lambert; David J. Connaughton, Jr.

(57) ABSTRACT

This invention relates to powder metallurgy, more specifically, to methods of fabricating hard alloy items. The invention can be used as an iron, cobalt or nickel base binder for the fabrication of diamond cutting tools for the construction industry and stone cutting, including segmented cutting discs of different designs and wires for reinforced concrete and asphalt cutting used in the renovation of highway pavements, runways in airports, upgrading of metallurgical plants, nuclear power plants, bridges and other structures, monolithic reinforced concrete cutting drills, as well as discs and wires for the quarry production of natural stone and large scale manufacturing of facing construction materials. This invention achieves the objective of providing binders for the fabrication of diamond tools having higher wear resistance without a significant increase in the sintering temperature, as well as higher hardness, strength and impact toughness. The achievement of these objectives by adding an iron group metal as the main component of the binder composition and alloying additives in the form of nanosized powder in accordance with this invention is illustrated with several examples of different type binders for the fabrication of diamond tools.

2 Claims, No Drawings

BINDER FOR THE FABRICATION OF DIAMOND TOOLS

CROSS REFERENCE TO RELATED APPLICATIONS

This application is the National Stage of PCT/RU2006/000491 filed on Sep. 25, 2006, which claims priority under 35 U.S.C. §119 of Russian Application No. 2005135024 filed on Nov. 14, 2005, Russian Application No. 2005135025 filed on Nov. 14, 2005, and Russian Application No. 2005135026 filed on Nov. 14, 2005. The international application under PCT article 21 (2) was published in English.

FIELD OF THE INVENTION

This invention relates to powder metallurgy, more specifically, to methods of fabricating hard alloy items. The invention can be used as an iron, cobalt or nickel base binder for the fabrication of diamond cutting tools for the construction industry and stone cutting, including segmented cutting discs of different designs and wires for reinforced concrete and asphalt cutting used in the renovation of highway pavements, runways in airports, upgrading of metallurgical plants, nuclear power plants, bridges and other structures, monolithic reinforced concrete cutting drills, as well as discs and wires for the quarry production of natural stone and large scale manufacturing of facing construction materials.

Binders determine the design of the tools. Depending on the type of the binder, the case material and the method of diamond containing layer bonding to the case are selected. The physical and mechanical properties of binders predetermine the possible shapes and sizes of abrasive diamond tools.

STATE OF THE ART

Known is a binder for the fabrication of diamond tools (RU 2172238 C2, published Aug. 20, 2001, cl. B24D 3/06) comprising copper as the base and tin, nickel, aluminum and ultrafine grained diamond as additives.

Disadvantages of said material are its insufficient wear resistance, hardness, strength and impact toughness.

Known is a binder for the fabrication of diamond tools (SU 1167840 A1, published Oct. 10, 1999) comprising an iron group metal, titanium carbide and a metal-metalloid compound. The binder further comprises zirconium carbide for higher binding strength and more reliable diamond grain fixation in the binder.

Disadvantages of said material also are its insufficient hardness and strength.

Known is a binder for the fabrication of diamond tools (SU 1021586 A, published Jun. 7, 1983, cl. B24D3/06) with cobalt as the base that comprises chromium carbide, copper, tin, iron and nickel as additives.

Disadvantages of said material are its insufficient wear resistance, hardness, strength and impact toughness.

Known is a binder for the fabrication of diamond tools with cobalt as the base and cobalt compounds, silicon, sulfur, magnesium, sodium and aluminum as additives (JP 7207301, published Aug. 8, 1995).

Disadvantages of said binder also are its insufficient hardness and strength.

Known is a binder for the fabrication of diamond tools (RU 2172238 C2, published Aug. 20, 2001, cl. B24D 3/06) comprising copper as the base and tin, nickel, aluminum and ultrafine powder (UFP) of diamond as additives.

Disadvantages of said material are its insufficient wear resistance, hardness, strength and impact toughness.

Known is a binder for the fabrication of diamond tools comprising over 40 wt. % nickel and alloying additives (JP 2972623 B2, published Feb. 2, 2005).

Disadvantages of said binder also are its insufficient hardness and strength.

Therefore the objective of this invention is the synthesis of binders for the fabrication of diamond tools having higher wear resistance without a significant increase in the sintering temperature, as well as higher hardness, strength and impact toughness.

DISCLOSURE OF THE INVENTION

Below are examples of a few types of binders for the fabrication of diamond tools according to this invention in which the objective of this invention is achieved by adding an iron group metal as the main component of the binder composition and alloying additives in the form of nanosized powder.

The binder for the fabrication of diamond tools comprises iron and an alloying additive in the form of nanosized powder. The content of the alloying additive in the binder is 1-15 wt. %.

In specific embodiments of this invention, the alloying additives are tungsten carbide, tungsten, aluminum oxide, zirconium dioxide or niobium carbide.

Also, in specific embodiments of this invention, the alloying additives are UFP diamonds coated with silver or nickel.

In another embodiment of this invention, the binder for the fabrication of diamond tools comprises cobalt and an alloying additive in the form of nanosized powder. The content of the alloying additive in the binder is 1-15 wt. %.

In specific embodiments of this invention, the alloying additives are tungsten carbide, tungsten, aluminum oxide, zirconium dioxide or niobium carbide.

Also, in specific embodiments of this invention, the alloying additives are UFP diamonds coated with silver or nickel.

In accordance with the third embodiment of this invention, the binder for the fabrication of diamond tools comprises nickel and an alloying additive in the form of nanosized powder. The content of the alloying additive (AA) in the binder is, wt. %

$$1.6<AA\leq 15.$$

In specific embodiments of this invention, the alloying additives are tungsten carbide, tungsten, aluminum oxide, zirconium dioxide or niobium carbide.

Also, in specific embodiments of this invention, the alloying additives are UFP diamonds coated with silver or nickel.

The presence of an iron group metal as the main component of the binder composition provides the binder satisfying the following requirements:

a) good wetting in relation to diamond;

b) good fixation of the diamond grains;

c) self-cutting, i.e. the situation in which the blunting of diamond grains causes wear-out of the tool that enhances the chipping out of the blunted grains and the uncovering of the cutting edges of new grains;

d) sufficient heat stability and a good heat conductivity;

e) a minimum friction coefficient in contact with the material to be processed;

f) linear expansion coefficient close to that of diamond;

g) lack of chemical interaction with the material to be processed and the cooling liquid.

Alloying additives of this composition have high hardness, heat resistance and heat stability of the binders.

EMBODIMENTS OF THE INVENTION

The binders can be synthesized by powder metallurgy, i.e. sintering followed by pressing at the sintering temperature. This method is highly productive because the overall duration of material heating to the sintering temperature, exposure to the sintering temperature, pressing and cooling to room temperature does not exceed 15 minutes. The high heating rates and the uniform temperature distribution in the processing chamber are provided by passing electric current through the sintering mold which is used also as the pressing mold. Upon the completion of the exposure to the sintering temperature, pressing is started immediately in order for the required density and shape of the manufactured items to be maintained. The pressing mould design allows the process to be conducted in an inert or protective atmosphere, this increasing tool quality.

Contents of the alloying additives that are below the minimum limit of the concentration range shown above (1 wt. % for iron and cobalt and 1.6 wt. % for nickel) are insufficient for their homogeneous distribution in the bulk of the material, and their effect on the structure and properties of the resultant material is negligible. If, on the other hand, the maximum limit of the abovementioned concentration range (15 wt. %) is exceeded, the concentration of the alloying material (the nanocomponent) becomes excessive. As the alloying material has a higher hardness compared with iron group metals, it acts as a stress concentrator thus strongly embrittling the material and reducing the mechanical properties and wear resistance of the binder.

Tables 1, 2 and 3 show examples illustrating binder properties as a function of composition.

TABLE 1

| Composition, wt. % | Rockwell Hardness (HRB), 1.5 mm/980 N* | Bending Strength $\sigma^{bend}$, MPa | Impact Toughness, KCU, J/cm$^2$ |
|---|---|---|---|
| 100% $Fe_{binder}$(B13) | 88 | 920 | 3.36 |
| 99.3% $Fe_{binder}$ + 0.7% alloying additive ($Al_2O_3$ or WC or W or $ZrO_2$ or NbC or $C_{diamond\ UFP}$ + Ni or $C_{diamond\ UFP}$ + Ag) | 93 | 915 | 3.36 |
| 99% $Fe_{binder}$ + 1.0% alloying additive ($Al_2O_3$ or WC or W or $ZrO_2$ or NbC or $C_{diamond\ UFP}$ + Ni or $C_{diamond\ UFP}$ + Ag) | 95 | 919 | 3.37? |
| 98% $Fe_{binder}$ + 2.0% alloying additive ($Al_2O_3$ or WC or W or $ZrO_2$ or NbC or $C_{diamond\ UFP}$ + Ni or $C_{diamond\ UFP}$ + Ag) | 98 | 1198 | 3.80 |
| 90% $Fe_{binder}$ + 10.0% alloying additive ($Al_2O_3$ or WC or W or $ZrO_2$ or NbC or $C_{diamond\ UFP}$ + Ni or $C_{diamond\ UFP}$ + Ag) | 104 | 1250 | 4.04 |
| 85% $Fe_{binder}$ + 15.0% alloying additive ($Al_2O_3$ or WC or W or $ZrO_2$ or NbC or $C_{diamond\ UFP}$ + Ni or $C_{diamond\ UFP}$ + Ag) | 101 | 1190 | 3.87 |

TABLE 1-continued

| Composition, wt. % | Rockwell Hardness (HRB), 1.5 mm/980 N* | Bending Strength $\sigma^{bend}$, MPa | Impact Toughness, KCU, J/cm$^2$ |
|---|---|---|---|
| 80% $Fe_{binder}$ + 20.0% alloying additive ($Al_2O_3$ or WC or W or $ZrO_2$ or NbC or $C_{diamond\ UFP}$ + Ni or $C_{diamond\ UFP}$ + Ag) | 90 | 850 | 3.15 |
| 78% $Fe_{binder}$ + 22.0% alloying additive ($Al_2O_3$ or WC or W or $ZrO_2$ or NbC or $C_{diamond\ UFP}$ + Ni or $C_{diamond\ UFP}$ + Ag) | 92 | 953 | 3.01 |

*Hardness was measured at the force 980 N using the ball 1.5 mm in diameter

TABLE 2

| Composition, wt. % | Rockwell Hardness, 1.5/980* | Bending Strength $\sigma^{bend}$, MPa | Impact Toughness, KCU, J/cm$^2$ |
|---|---|---|---|
| 100% $Co_{binder}$(B13) | 88 | 920 | 3.36 |
| 99.3% $Co_{binder}$ + 0.7% alloying additive ($Al_2O_3$ or WC or W or $ZrO_2$ or NbC or $C_{diamond\ UFP}$ + Ni or $C_{diamond\ UFP}$ + Ag) | 90 | 919 | 3.37 |
| 99% $Fe_{binder}$ + 1.0% alloying additive ($Al_2O_3$ or WC or W or $ZrO_2$ or NbC or $C_{diamond\ UFP}$ + Ni or $C_{diamond\ UFP}$ + Ag) | 93 | 919 | 3.37 |
| 98% $Co_{binder}$ + 2.0% alloying additive ($Al_2O_3$ or WC or W or $ZrO_2$ or NbC or $C_{diamond\ UFP}$ + Ni or $C_{diamond\ UFP}$ + Ag) | 98 | 1198 | 3.80 |
| 90% $Co_{binder}$ + 10.0% alloying additive ($Al_2O_3$ or WC or W or $ZrO_2$ or NbC or $C_{diamond\ UFP}$ + Ni or $C_{diamond\ UFP}$ + Ag) | 104 | 1250 | 4.04 |
| 85% $Co_{binder}$ + 15.0% alloying additive ($Al_2O_3$ or WC or W or $ZrO_2$ or NbC or $C_{diamond\ UFP}$ + Ni or $C_{diamond\ UFP}$ + Ag) | 103 | 1220 | 3.90 |
| 80% $Co_{binder}$ + 20.0% alloying additive ($Al_2O_3$ or WC or W or $ZrO_2$ or NbC or $C_{diamond\ UFP}$ + Ni or $C_{diamond\ UFP}$ + Ag) | 101 | 1190 | 3.87 |
| 78% $Co_{binder}$ + 22.0% alloying additive ($Al_2O_3$ or WC or W or $ZrO_2$ or NbC or $C_{diamond\ UFP}$ + Ni or $C_{diamond\ UFP}$ + Ag) | 92 | 953 | 3.01 |

*Hardness was measured at the force 980 N using the ball 1.5 mm in diameter

TABLE 3

| Composition, wt. % | Rockwell Hardness, 1.5/980* | Bending Strength $\sigma^{bend}$, MPa | Impact Toughness, KCU, J/cm$^2$ |
|---|---|---|---|
| 100% $Ni_{binder}$ (B13) | 88 | 920 | 3.36 |
| 99.3% $Ni_{binder}$ + 0.7% alloying additive ($Al_2O_3$ or WC or W or $ZrO_2$ or NbC or $C_{diamond\ UFP}$ + Ni or $C_{diamond\ UFP}$ + Ag) | 93 | 919 | 3.37 |
| 99% $Ni_{binder}$ + 1.65% alloying additive ($Al_2O_3$ or WC or W or $ZrO_2$ or NbC or $C_{diamond\ UFP}$ + Ni or $C_{diamond\ UFP}$ + Ag) | 98 | 1198 | 3.80 |
| 98% $Ni_{binder}$ + 2.0% alloying additive ($Al_2O_3$ or WC or W or $ZrO_2$ or NbC or $C_{diamond\ UFP}$ + Ni or $C_{diamond\ UFP}$ + Ag) | 101 | 1200 | 3.90 |

TABLE 3-continued

| Composition, wt. % | Rockwell Hardness, 1.5/980* | Bending Strength $\sigma^{bend}$, MPa | Impact Toughness, KCU, J/cm$^2$ |
|---|---|---|---|
| 90% $Ni_{binder}$ + 10.0% alloying additive ($Al_2O_3$ or WC or W or $ZrO_2$ or NbC or $C_{diamond\ UFP}$ + Ni or $C_{diamond\ UFP}$ + Ag) | 104 | 1250 | 4.04 |
| 85% $Ni_{binder}$ + 15.0% alloying additive ($Al_2O_3$ or WC or W or $ZrO_2$ or NbC or $C_{diamond\ UFP}$ + Ni or $C_{diamond\ UFP}$ + Ag) | 102 | 1200 | 4.00 |
| 80% $Ni_{binder}$ + 20.0% alloying additive ($Al_2O_3$ or WC or W or $ZrO_2$ or NbC or $C_{diamond\ UFP}$ + Ni or $C_{diamond\ UFP}$ + Ag) | 102 | 1190 | 3.87 |
| 78% $Ni_{binder}$ + 22.0% alloying additive ($Al_2O_3$ or WC or W or $ZrO_2$ or NbC or $C_{diamond\ UFP}$ + Ni or $C_{diamond\ UFP}$ + Ag) | 92 | 953 | 3.01 |

*Hardness was measured at the force 980 N using the ball 1.5 mm in diameter

The binder materials according to this invention will provide for better economic parameters as compared to the counterpart materials of the world's leading manufacturers with respect to the price/lifetime and price/productivity criteria. For example, the diamond containing segments for asphalt cutting discs are operated in a superhard abrasive medium. The conventional matrix hardening method by introducing tungsten carbide has a concentration limitation due to the consequent increase in the required sintering temperature (this, in turn, reduces the strength of the diamonds and causes additional wear of the process equipment).

The introduction of alloying additives in the form of nanosized particles in the binder allows increasing its wear resistance without a significant increase of the sintering temperature. Granite cutting disc segments are used in the large scale manufacturing of construction facing materials and are therefore a large scale product, too. Their production costs and unit operational costs are an important economic factor in the respective production industries. The transition from conventional binders to iron group metal base binders will reduce the raw material costs. In the meantime, the operational parameters (wear resistance, hardness and impact toughness) of such binders will be retained by introducing nanosized particles of WC, $Al_2O_3$ and other additives.

The materials used as binders for the synthesis of pearlines suitable for hot pressing have largely reached their operational limits. Further development is oriented to the hot isostatic pressing technology which requires very large capital investment in process equipment, often reaching millions dollars. On the other hand, hot pressing combined with the introduction of nanosized particles allows pearlines to be obtained with parameters close to those obtained using the hot isostatic pressing technology.

The introduction of alloying additions, i.e. tungsten carbide, tungsten, aluminum oxide, zirconium dioxide or niobium carbide, in the form of nanosized powder provides for the high strength, heat conductivity and cracking resistance of the material. The controlled small additions of the alloying components provide for a unique combination of properties, i.e. strength, hardness, cracking resistance and cutting area friction coefficient thereby allowing the service life of tools operated under extremely high loading conditions to be increased by 10-20% compared to the initial ones, without compromise in the cutting capacity.

The invention claimed is:

1. A binder for the fabrication of diamond tools, the binder consisting of (1) a basis and (2) an alloying additive, wherein said binder is a material sintered and pressed at the sintering temperature, wherein said basis consists of iron, cobalt, or nickel, and said alloying additive is tungsten carbide, zirconium dioxide, or niobium carbide, wherein the alloying additive being in the form of a powder with particles sizes less than 100 nanometers, and wherein the alloying additive is in an amount of 2-10 wt. %, wherein the claimed ranges of wt. % refer to the alloying additive.

2. The binder of claim 1 wherein the alloying additive is in an amount of 10 wt. %.

* * * * *